US005694895A

United States Patent [19]

Tsunoda et al.

[11] Patent Number: 5,694,895

[45] Date of Patent: Dec. 9, 1997

[54] OUTBOARD ENGINE STRUCTURE

[75] Inventors: Masaki Tsunoda; Takao Kashima; Shigeaki Kuwabara; Mituru Nakamura; Kazuhiro Satou, all of Wako, Japan

[73] Assignee: Honda Giken Kogyo Kabushiki Kaisha, Tokyo, Japan

[21] Appl. No.: 534,949

[22] Filed: Sep. 28, 1995

[30] Foreign Application Priority Data

Sep. 30, 1994 [JP] Japan ..... 6-237570
Sep. 30, 1994 [JP] Japan ..... 6-237679

[51] Int. Cl.[6] ..... F02M 17/00

[52] U.S. Cl. ..... 123/179.24; 123/179.28; 123/195 E; 123/195 P; 123/41.31

[58] Field of Search ..... 123/195 A, 195 E, 123/195 P, 41.31, 179.24, 179.28

[56] References Cited

U.S. PATENT DOCUMENTS 4,930,467 6/1990 Masuda et al. ..... 123/179.24
5,078,627 1/1992 Anderson ..... 123/198 D

FOREIGN PATENT DOCUMENTS 60-184624 6/1987 Japan .
6-129257 5/1994 Japan .

*Primary Examiner*—Noah P. Kamen
*Attorney, Agent, or Firm*—Merchant, Gould Smith, Edell, Welter & Schmidt P.A.

[57] ABSTRACT

In an outboard engine, an electric device is attached, utilizing a cooling water passage cover for closing a recessed part constituting part of a cooling water jacket, to the cover via a boss part, thus providing a compact electric device mounting structure with no such parts projecting from a side of an engine as in a conventional box member. An engine starting apparatus of the outboard engine is provided with an ignition device and a starter motor connected to a battery, and an AC generator is connected to the battery via an electric device having voltage restricting and rectifying functions. When it is cranked by the starter motor or a starter pulley, the engine is started by the ignition device operated by the battery. As it is cranked by the starter pulley while the battery is discharging, the ignition device is actuated by a current generated by the AC generator and rectified by the electric device to thereby start the engine. As a result, the AC generator provided in the engine starting apparatus of the outboard engine can be made small, and high ignition performance can be achieved by either the starter motor or manually.

10 Claims, 7 Drawing Sheets

OUTBOARD ENGINE STRUCTURE

FIELD OF THE INVENTION

The present invention relates generally to an outboard engine structure, and, in particular, to a structure for mounting an electric device comprised of a rectifier and/or a voltage regulator to the outboard engine, and to an engine starting apparatus to be mounted to the outboard engine for starting the same.

BACKGROUND OF THE INVENTION

A structure for mounting an electric device onto an outboard engine is known from, for example, Japanese Utility Model Laid-Open Publication No. SHO 62-93116.

In this Laid-Open Publication No. SHO 62-93116, there is disclosed an electric device mounting structure which includes a box member attached to one side of an engine body by means of a boss thereof and having a recessed part in its side facing the engine for accommodating the electric device.

However, in this electric device mounting structure, the box member projects outwardly from the engine, and a space corresponding to the projected part of the box member is required around the engine. Consequently, the structure may not be rendered spatially compact.

An apparatus for starting an outboard engine is known from, for example, Japanese Patent Laid-Open Publication No. HEI 6-129257.

The outboard engine starting apparatus disclosed in Japanese Laid-Open Patent Publication No. HEI 6-129257 includes an AC generator mounted on an end of a crank shaft of the engine. In the stator of this AC generator, there are provided an exciter coil for supplying electrical power to an ignition device as and after the engine gets started, and a charging coil for charging a battery while the engine is running.

In the AC generator of the engine starting apparatus disclosed in the publication HEI 6-129257, the two coils are required to perform two different functions. In order for the coils to have sufficient capacity for the respective functions, the AC generator need be made large in size. However, due to a limited space, this is not permitted and hence the exciter coil may not be rendered capable of supplying a sufficient igniting output. As a result, the required igniting performance is achieved by making a flywheel and a starter motor large in size.

It is therefore a first object of the present invention to provide a structure for making an overall outboard engine compact.

A second object of the invention is to provide a compact electric device mounting structure which is capable of preventing increase in temperature of electric devices and may be free from interferences by parts, disposed around a cylinder block, such as a starter motor and an electric device accommodating box.

It is a third object of the invention to provide an outboard engine starting apparatus which enables down-sizing of an AC generator and is capable of achieving high igniting performance by a motor or manually.

SUMMARY OF THE INVENTION

The first object may be met by an outboard engine structure which comprises an electric device including a regulator and/or a rectifier, and an engine adapted to be started by an ignition device which in turn may be actuated by electric motor or manual cranking, wherein the outboard engine structure further includes mount means for mounting the electric device, utilizing a cooling water passage cover for closing a recessed part constituting a cooling water jacket, to the cover, and engine starting means including a starter motor and an igniting device connected to a battery, with an AC generator being connected to the battery via the electric device capable of performing voltage restricting and rectifying functions.

The second object may be achieved by a structure for mounting an electric device to an outboard engine, comprising a cylinder block including at least one cylinder formed therein, a recessed part formed in the cylinder block at a position away from the cylinder and constituting part of a cooling water jacket, cover means secured to the cylinder block and covering the cooling water jacket such that the recessed part is closed, boss means projectedly provided on the cover means, and an electric device attached to the boss means and having a number of cooling fins.

In one specific form of the electric device mounting structure, the cover means has a peripheral edge secured to the cylinder block by means of a bolt, the recessed part and the peripheral edge have portions extending along one direction of the cylinder block, and the electric device is shaped to extend along the one direction.

With the structure thus arranged, it is possible to provide a compact electric device mounting structure, because the electric device may be attached, utilizing the cover for closing the recessed part constituting the cooling water jacket, to the cover by means of the boss, thus avoiding provision of a part of a known box member, which projects to a side of the engine.

The third object may be achieved by an apparatus for starting an engine to be mounted on an outboard engine, comprising motor starter means adapted to be actuated by a battery for cranking the engine, manual starter means for manually cranking the engine, an ignition device connected to the battery, an AC generator adapted to be driven by the engine, and an electric device for voltage restricting and rectifying an alternating current generated by the AC generator and supplying the resulted current to the ignition device and the battery.

In one specific form, the ignition device and the motor starter means are connected in parallel to the battery, and the AC generator is also connected thereto by means of the electric device.

The electric device includes a full-wave bridge rectifier circuit employing four diodes, two thyristors and a control circuit for controlling the thyristors.

When the engine is cranked by the motor starter means or manual starter means, the ignition device connected to the battery is actuated, and the engine gets started. After the engine is started, an alternating current generated by the AC generator is voltage restricted and rectified by the electric device, and the battery is charged. When the engine is cranked by the manual starter means in timed relation with discharging of electrical power from the battery, a direct current, generated by the AC generator and then voltage restricted and rectified by the electric device, is supplied to the ignition device, whereby the engine gets started without any problems.

Thus, according to the present invention, the engine can be started by either a motor or manual means and can surely be started even by a compact, small output motor starter means or low-cranking-speed manual starter means.

Also, because there are provided the AC generator driven by the engine and the electric device for voltage restricting and rectifying an alternating current generated by the AC generator and supplying the resultant current to the ignition device and the battery, the engine can be manually started during discharging of the battery.

Furthermore, according to the invention, since no ignition devices have AC power sources, it is required of the AC generator to have only one coil for supplying power to the battery and the ignition device, thus enabling size reduction of the AC generator.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
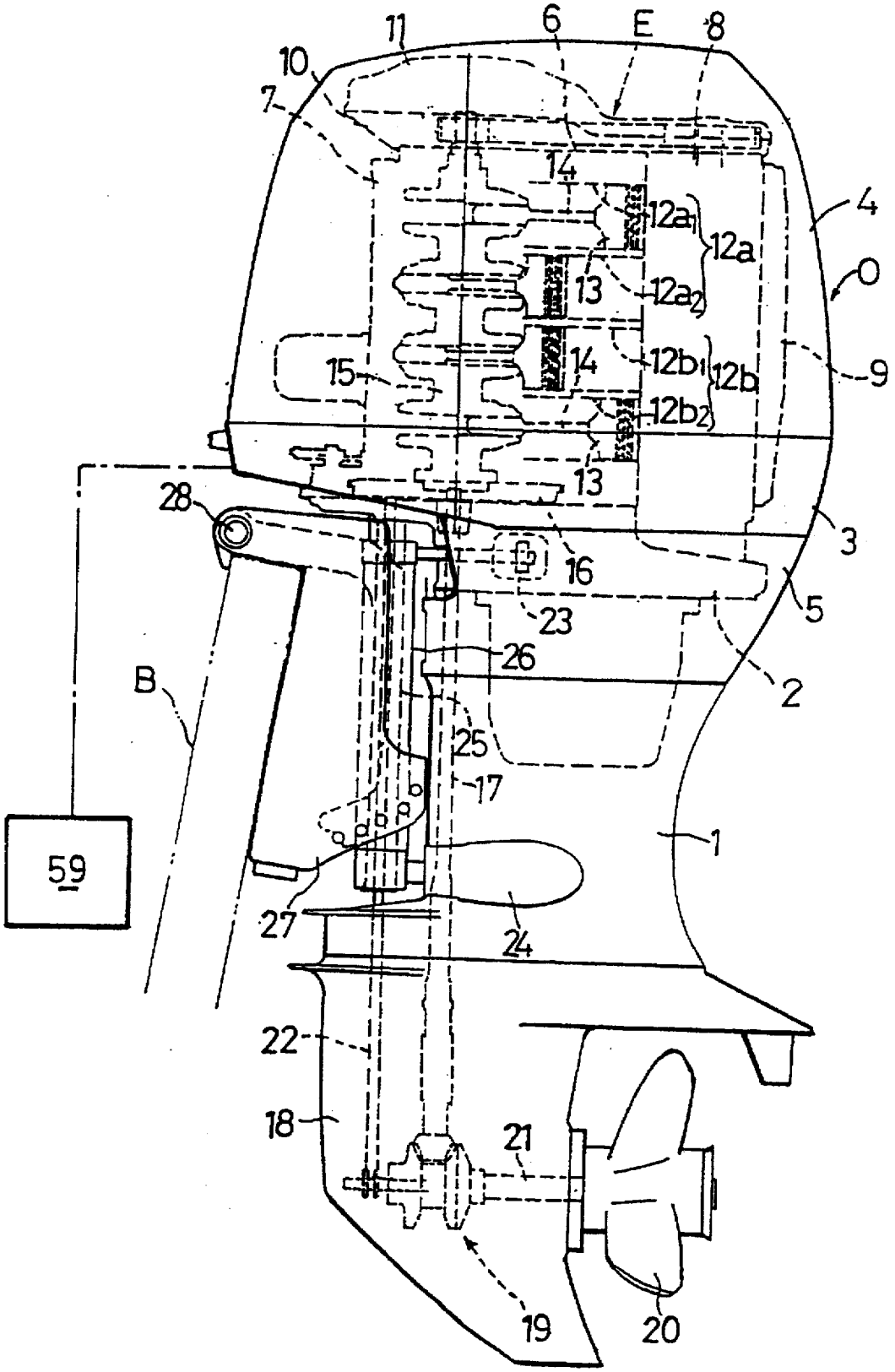
FIG. 1 is a side view showing the overall structure of an outboard engine.

Referring to FIG. 1, an outboard engine O comprises a mount case 2 connected to an extension case 1. An in-line four-cylinder, four stroke engine E is mounted to an upper surface of the mount case 2, to which an under case 3 having an opened upper surface is connected. An engine cover 4 is removably fitted to an upper part of this under case 3. An under cover 5 is connected between a lower edge of the under case 3 and an upper edge of the extension case 1.

The engine E includes a cylinder block 6, a crank case 7, a cylinder head 8, a head cover 9, a lower belt cover 10, and an upper belt cover 11. The cylinder block 6 and the crank case 7 are secured to the upper surface of the mount case 2. Four cylinders $12a_1$, $12a_2$ and $12b_1$, $12b_2$ are disposed within the cylinder block 6. In the cylinders $12a_1$, $12a_2$ and $12b_1$, $12b_2$, corresponding pistons 13 are slidably received. The pistons 13 are connected, via connecting rods 14 (often called con-rods), to a vertically disposed crankshaft 15.

A drive shaft 17 is connected to a lower end of the crankshaft 15 together with a flywheel 16. The drive shaft 17 extends downwardly within the extension case 1 and is connected at a lower end, by means of a bevel mechanism 19 provided in a gear case 18, to a propeller shaft 21 having a propeller 20 on its rear end. A lower end of a shifting rod 22 for switching the rotational direction of the propeller shaft 21 is connected to a front side of the bevel gear mechanism 19.

Reference numeral 25 represents a swivel shaft attached between an upper mount 23 provided on the mount case 2 and a lower mount 24 provided on the extension case 1. A swivel case 26 for rotatably supporting the swivel shaft 25 is supported on a stern bracket 27 mounted on a stern B via a tilt shaft 28 so as to be swingable up and down.

Figure 2:
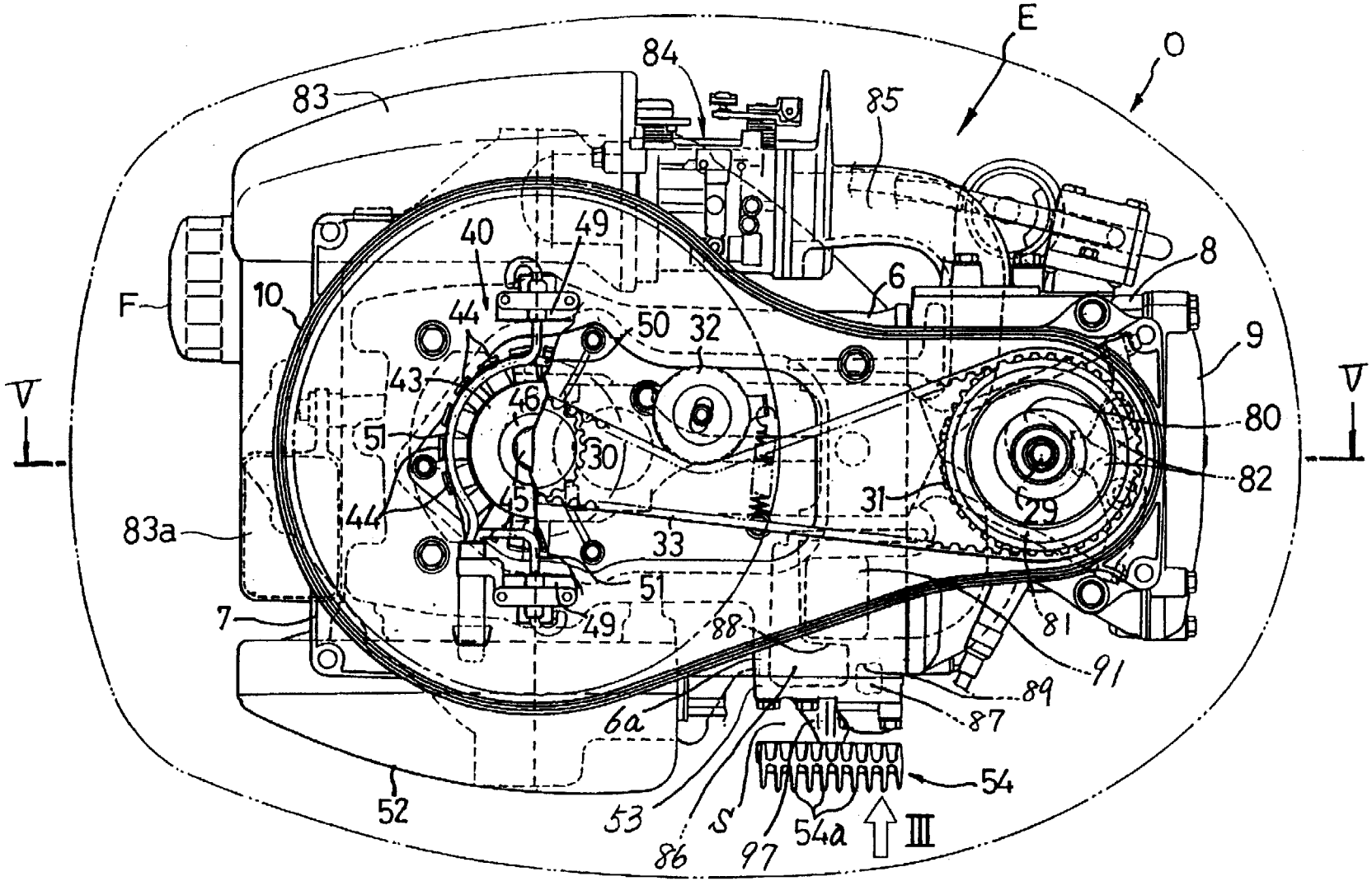
FIG. 2 is a top plan view showing the engine with parts omitted for clarity.

FIG. 2 is a top plan view of the engine E. One camshaft 29 parallel to the crankshaft 15 is rotatably supported on the cylinder head 8. A crank pulley 30 is provided on the upper end of the crankshaft 15 while a cam pulley 31 is provided on the upper end of the camshaft 29. A timing belt 33, whose tension may be adjusted by a tensioning pulley 32, is wound around the crank pulley 30 and the cam pulley 31.

A cam 80 is formed on the camshaft 29. One end of a locker arm 82 for holding a valve stem 81 is abutted against the cam 80, and a valve may be opened and closed by rotation of the camshaft 29 via the cam 80 and the locker arm 82.

A first air intake silencer 83 is disposed on one side of the cylinder block 6. One end of an intake pipe 85 is attached to a carburetor 84 connected to the first air intake silencer 83 and the other end of the intake pipe 85 is attached to an air intake port of the engine E. In order to make intake muffling more effective, a second air intake silencer 83*a* is disposed in front of the cylinder block 6 so as to be connected to the first air intake silencer 83. An electric device box 52 accommodating a DC power source igniter (CDI; Capacitor Discharge Ignition) is attached to one side of the cylinder block 6 opposed to the first air intake silencer 83. Reference sign F indicates an oil filter for cleaning lubricating oil.

A projected part 6*a* is formed in the side of the cylinder block 6, and foreward and return paths 86 and 87 of the cooling water jacket are provided in the projected part 6*a*. These forward and return cooling water paths 86 and 87 are formed by attaching a cooling water passage cover 53 to recessed parts 88 and 89 constituting parts of the cooling water jacket formed in the projected part 6*a*. The cooling water forward and return paths 86 and 87 are positioned around an exhaust passage 91.

Figure 3:
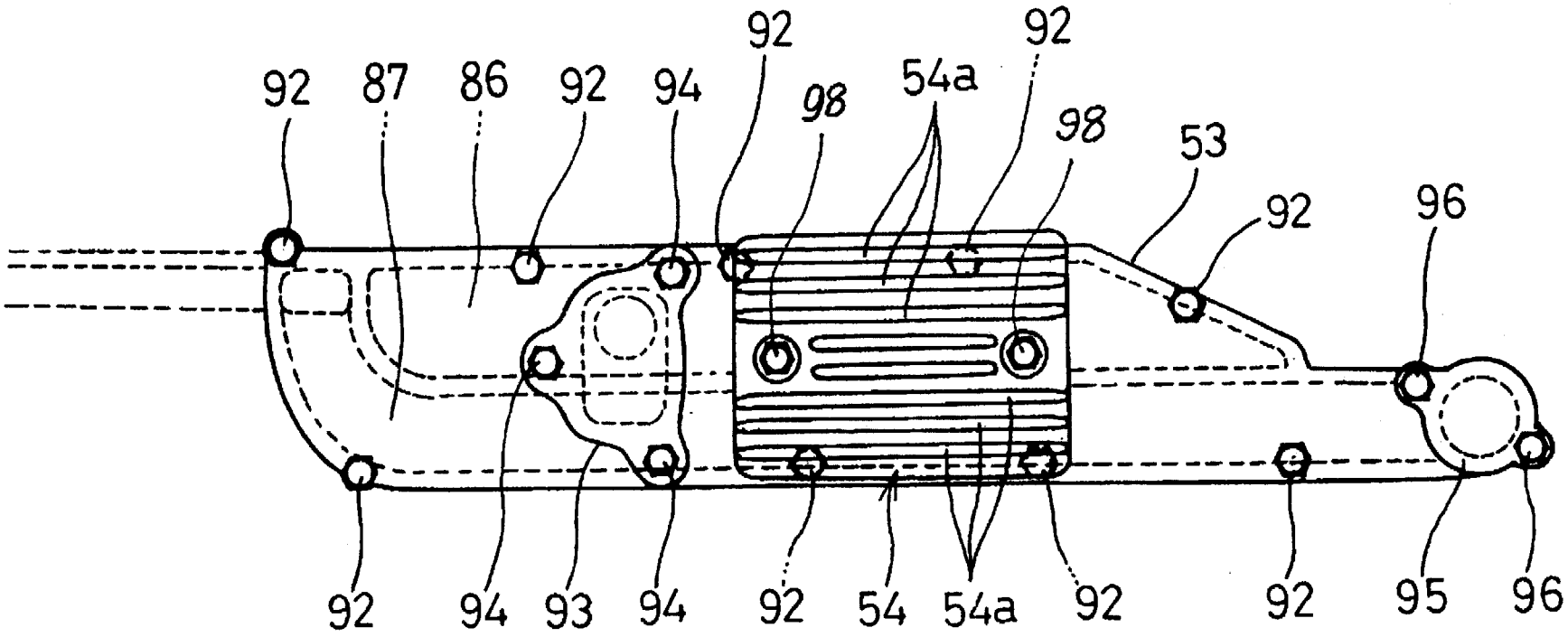
FIG. 3 is a front elevational view showing a cooling water passage cover as seen from the direction of an arrow III shown in FIG. 2.

FIG. 3 is a view of the cooling water passage cover 53 as seen in the direction of arrow III of FIG. 2. The cover 53 is elongated to extend along the cooling water forward and return paths 86, 87, and its peripheral edge is fixed in the cylinder block 6 by a plurality of bolts 92. A relief valve 93 is attached to the cover 53 by bolts 94. A thermostat 95 is attached to the cover 53 by bolts 96.

As shown in FIG. 2, a boss part 97 is formed on the cooling water passage cover 53. An electric device 54, including a rectifier and/or a regulator, is attached to the boss part 97 by means of bolts 98. The electric device 54 is, as shown in FIG. 3, almost equal in up-and-down width to the cover 53, and a number of cooling fins 54*a* are formed on upper and lower surfaces of the electric device 54. By virtue of these cooling fins 54*a*, cooling performance and strength of the electric device 54 may be improved.

As explained above, in the electric device mount structure according to the first preferred embodiment of the invention, the cooling water passage cover is utilized in securing the electric device 54 to the cylinder block 6. Specifically, the electric device 54 is attached to the cover 53 by means of the boss part 97. As a result, it is no longer necessary for the engine body to have a box member attached to its side by means of a boss, as found in the conventional arrangement, and hence there are no parts projecting outwardly from the side of the cylinder block 6, thus providing a compact electric device mount structure.

The electric device mount structure is also preferable in that the electric device 54 may be kept at the same temperature as the cooling water since it is attached to the cooling water passage cover 53.

Also, since the electric device 54 may be attached to the cooling water passage cover 53 by means of the boss part 97, it is possible to form a space S, as shown in FIG. 2, between the cover 53 and the electric device 54, through which a cooling air can be fed against the electric device effectively.

Further, since the plurality of bolts 92 are disposed in the peripheral edge of the cooling water passage cover 53, it is possible to easily perform tightening and loosening operations with respect to those four bolts of the plurality of bolts 92 which are covered by the electric device 54 (indicated by dotted line in FIG. 3). The electric device 54 has an up-and-down width almost equal to the width of the cover 53, and this will make the tightening and loosening operations with respect to the four bolts covered by the electric device 54 still easier.

Since it is disposed substantially within the width of the cooling water passage cover 53, the electric device 54 may be free from influence by parts disposed around the cylinder block 6 at areas apart from the cover 53, such as the starter motor 56, electric device box 52 and the like.

Figure 5:
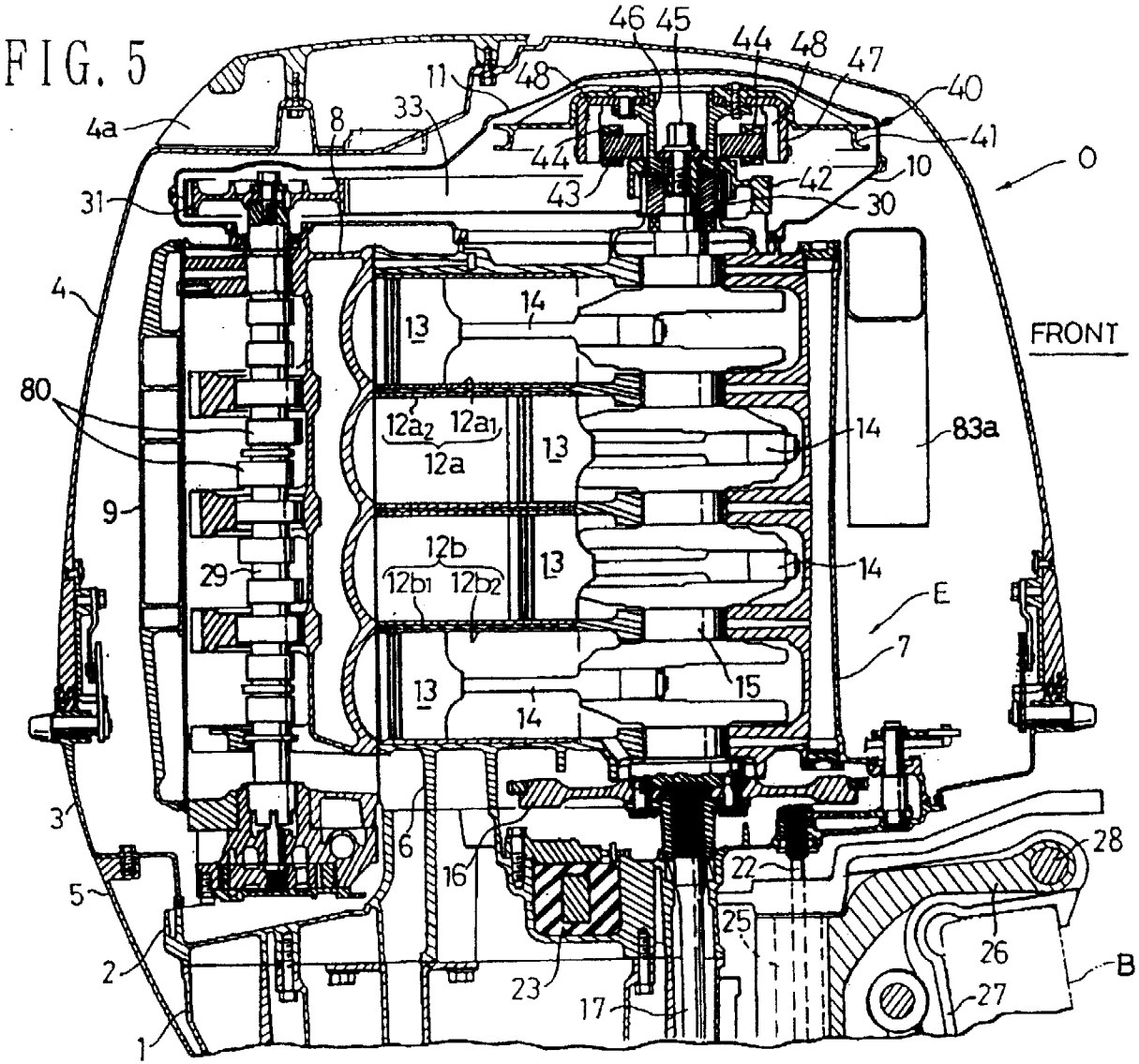
FIG. 5 is a sectional view taken along line V—V shown in FIG. 2.

Next, explanation will be made as to an engine starting apparatus according to a second preferred embodiment of the present invention, having reference to FIG. 2 and FIG. 5.

An AC generator 40 and a starter pulley 41 are provided on the upper part of a crank pulley 30 disposed on the upper end of the crankshaft 15.

The AC generator 40 has a plurality of stator cores 43, a plurality of charging coils 44, a rotor 47, and a plurality of permanent magnets 48. The stator cores 43 are supported on the upper end of the crank case 7 via a supporting member 42. The charging coils 44 are disposed along the outer periphery of the stator cores 43. The rotor 47 is fixed to a rotor boss 46 which is in turn connected to the upper end of the crankshaft 15 by means of a bolt 45. The permanent magnets 48 are fixed to the inner periphery of the rotor 47 facing the coils 44.

In order to detect the phase of the crankshaft 15, a pair of pickups 49, 49, mounted on the supporting member 42, are disposed in opposed relation to the outer periphery of the rotor 47. The starter pulley 41 is fixed to the upper surface of the rotor 47. By pulling a rope wound around the pulley 41 to cause the latter to be rotated, the engine E can be started, when so desired.

Figure 4:
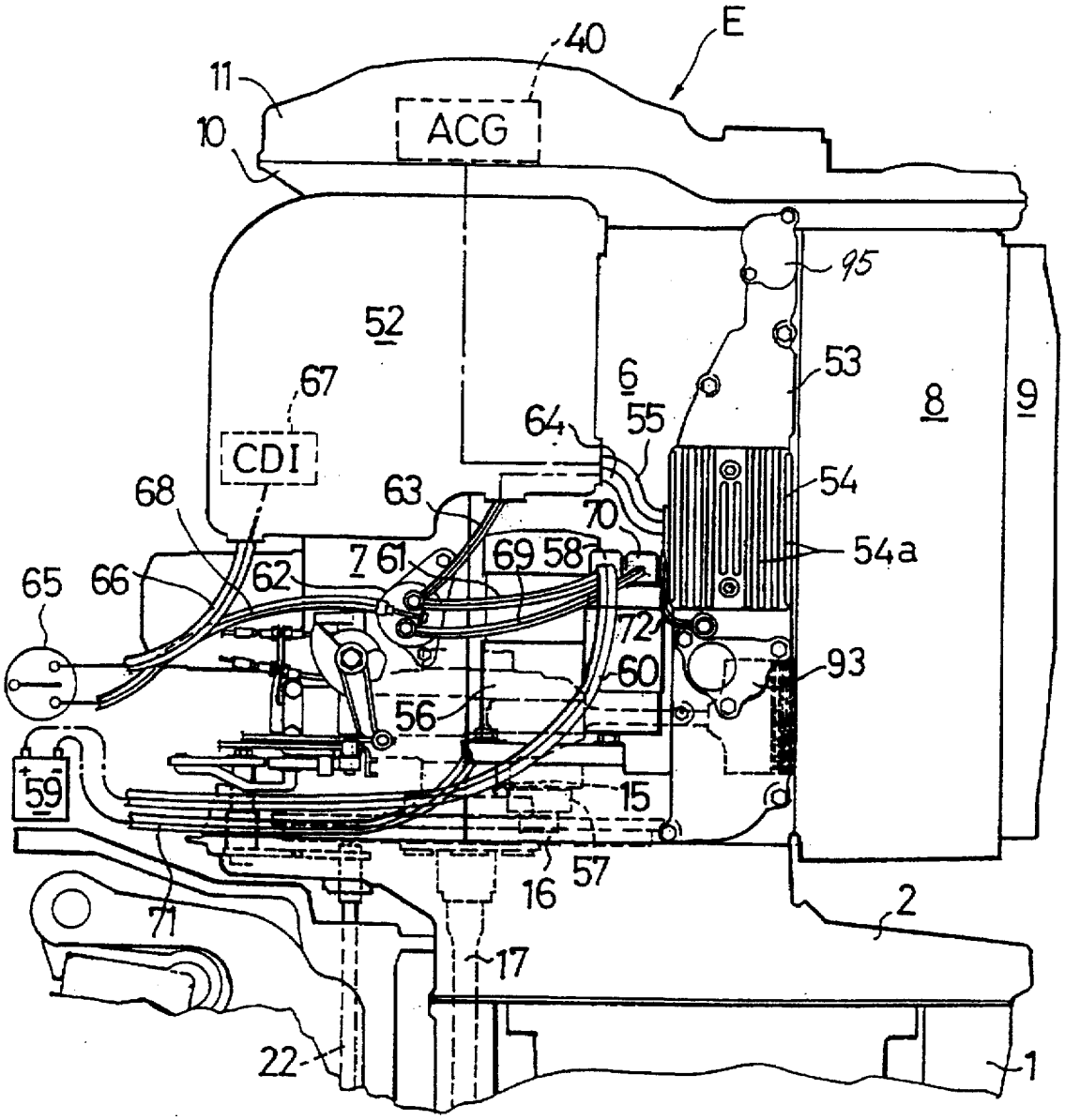
FIG. 4 is an enlarged view illustrating dominant parts of the engine of FIG. 1.

One cord 50 connected to the coil 44 and two cords 51, 51 connected to the respective pickups 49, 49 are bundled together, and the bundled cords 51, 51 lead to an electric device box 52 mounted on the cylinder block 6 and the crank case 7, shown on the left side of FIG. 4.

The electric device 54, including a rectifier and a regulator, is for rectifying an alternating current generated by an AC generator 40 and for restricting an upper limit value of a voltage thereof, and a cord 55 extending therefrom is connected to a cord 50 extending from the coils 44 of the AC generator 40 inside the electric device box 52, as shown in FIG. 4.

A jumping-in type pinion 57, provided on an output shaft of the starter motor 56 supported on the left side of the cylinder block 6, is disposed in opposed relation to a starter gear formed on the outer periphery of the flywheel 16 for meshing engagement therewith. One terminal 58 of the starter motor 56 is connected to a battery 59 provided inboard via a cord 60. A cord 61 connected to the terminal 58 extends internally of the electric device box 52 via a relay switch 62 and a cord 63 and is connected to a cord 64 extending from the electric device 54.

A key switch 65 of a remote control box provided inboard is connected to the ignition device 67 of a DC power source provided inside the electric device box 52 via a cord 66, and the key switch 65 is connected to the other terminal 70 of the starter motor 56 via a cord 68, the relay switch 62 and a cord 69. Represented by 71 and 72 are grounding cords. An air intake port 4a is lastly linked with the intake port of the engine E.

Figure 6:
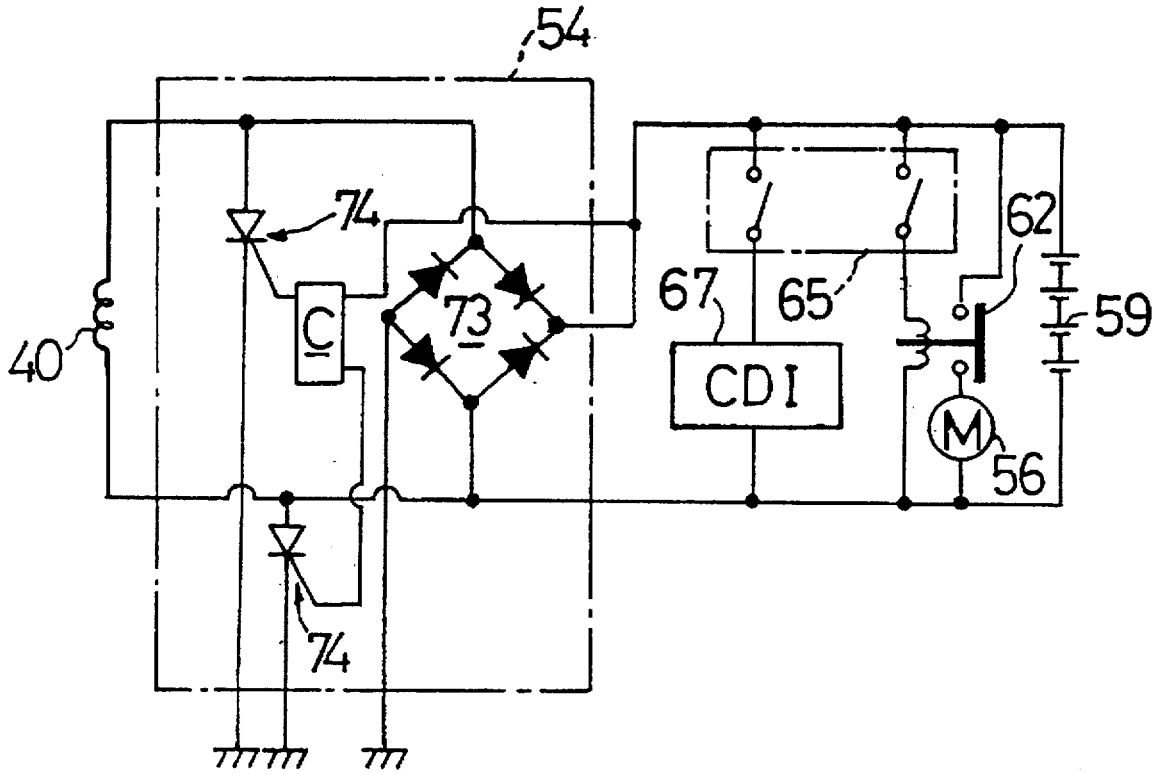
FIG. 6 is a circuit diagram of a starting apparatus according to the invention.

FIG. 6 illustrates an electric circuit of the starting apparatus of the engine E according to the second embodiment of the invention.

Loads such as the ignition device 67 and the starter motor 56 are connected in parallel to a battery 59. The AC generator 40 is connected to the battery 59 via the electric device 54. The electric device 54 is provided with a full-wave bridge rectifier circuit 73 using four diodes, two thyristors 74, 74 and a control circuit C for controlling the thyristors 74, 74.

The full-wave bridge rectifier circuit 73 rectifies an alternating current generated by the AC generator 40, actuates the ignition device 67 of a DC power source, and charges the battery 59. The thyristors 74, 74 are, in order to prevent damage to the ignition device 67 and the starter motor 56 by an excess voltage output from the AC generator 40 due to an increase in an engine speed, phase-controlled by the control circuit C so as to restrict the upper limit value of a voltage applied thereto.

Next, explanation will be made on the engine starting apparatus having the above-described structure according to the second embodiment.

When the key switch 65 is switched ON to start the engine E, the ignition device 67 is connected to the battery 59 and actuated. At the same time the relay switch 62 is placed in a starting position, and the starter motor 56 is driven, whereafter the engine E is started by cranking of the starter motor 56. During operation of the engine E, an alternating current generated by the AC generator 40 provided on the crankshaft 15 is rectified while a voltage value thereof is restricted and rectified in the electric device 54 and then used for charging the battery 59.

In case where the engine E is to be started manually without using the starter motor 56, the key switch 65 is switched ON, whereupon the ignition device 67 is connected to the battery 59 and in this state cranking may be performed using the starter pulley 41 of the AC generator 40. Even where the battery 59 is in a discharging state at this time, the engine E can be started without any problem, because a current generated by the AC generator 40 may be supplied to the ignition device 67 via the electric device 54 through cranking of the starter pulley 41.

Figure 7:
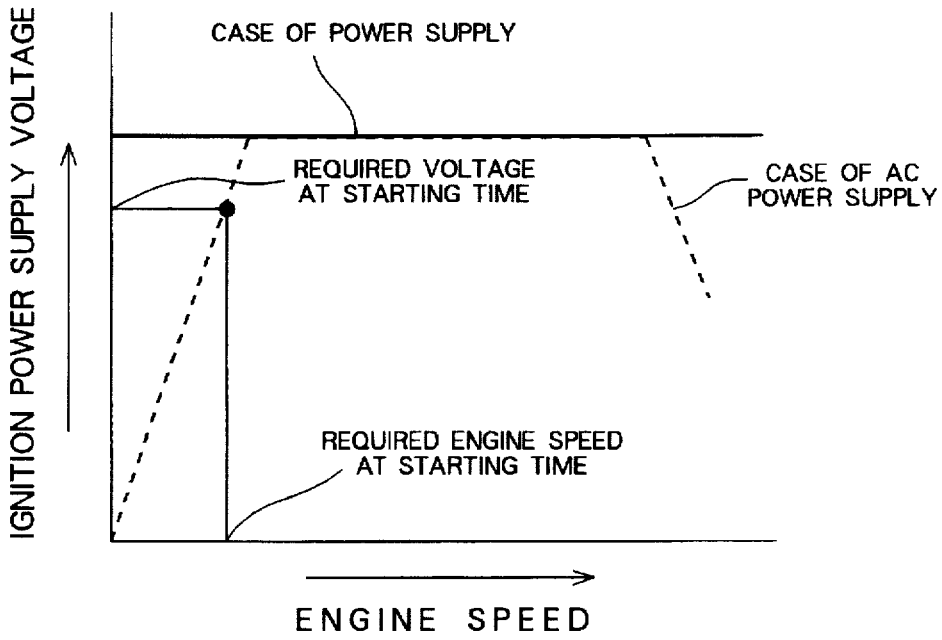
FIG. 7 is a graph showing a relationship between an engine speed and an ignition power voltage.

Compared to the conventional technique in which the engine E is started by providing an igniting power supply exciter coil in an AC generator and using an ignition device connected to the exciter coil, the engine E according to the preferred embodiment just described may be started using the ignition device 67 with the battery 59 as a power source. As a result, the inventive engine E has the following advantages:

As shown in FIG. 7, in the ignition device 67 using the battery 59 as a power source, since the power supply voltage of the battery 59 may be constant and a direct current generated by the AC generator 40, passed through the electric device 54 and having pulsation is smoothed by the battery 59 functioning as a capacitor, the ignition power supply voltage will be constant irrespective of the cranking speed (engine speed). On the contrary, in a conventional ignition device using an AC generator having an exciter coil as a power source, since the ignition power supply voltage increases with an increase in the cranking speed, the engine E cannot be started unless a predetermined cranking speed is reached.

Figure 8:
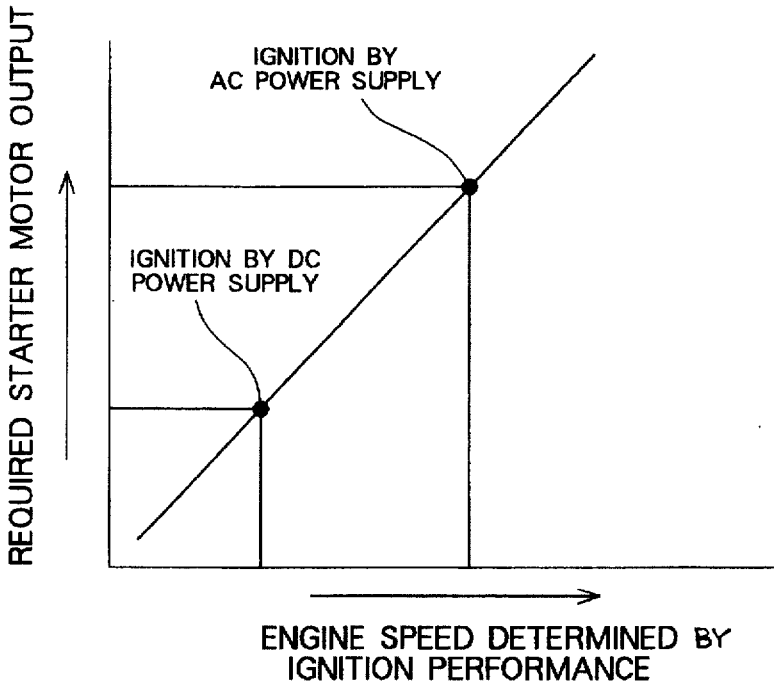
FIG. 8 is a graph showing a relationship between an engine speed and a starter motor request output determined by ignition performance.

Thus, as shown in FIG. 8, a cranking speed (engine speed) determined by igniting performance is smaller when a DC power source is used for the ignition device 67 than when an AC power source is used for the ignition device, and the output required of the starter motor 56 is smaller in the former than in the latter. As a result, it is possible to obtain sufficient igniting performance with a compact, light, small output starter motor 56.

In case where the engine is manually started using the starter pulley 41, chance of ignition may be small, because the cranking speed is lower and the cranking period is shorter than when the starter motor 56 is used. However, as previously described, since a direct current generated by the AC generator 40 and passed through the electric device 54 has a constant voltage, the engine can be surely started even by the starter pulley 41.

Therefore, by adoption of the ignition device 67 which employs the battery 59 as a power source, it is no longer necessary to rely on the conventional ignition device which uses an alternating current as a power source. It is no longer necessary for the AC generator 40 to have an exciter coil but a charging coil 44, thus achieving down-sizing of the generator 40.

Although various embodiments of the present invention have been thus far explained in detail, it should be understood that various changes can be made to the preferred embodiments without departing from the scope defined in the appended claims.

What is claimed is:

1. An outboard engine structure including an electric device having a regulator and/or a rectifier, and an engine adapted to be started by an igniting device which in turn may be actuated by motor or manual cranking, comprising:

mount means for mounting said electric device, utilizing a cooling water passage cover for closing a recessed part constituting a cooling water jacket, to said cover; and engine starting means including an ignition device connected to a battery for excitation thereof and a starter motor connected to said battery and adapted to be actuated by said battery for automatically cranking the engine; and an AC generator being connected to said battery via said electric device, wherein said electric device is capable of performing voltage restricting and rectifying functions, said generator is manually rotatable to manually crank the engine, and said generator, when manually rotated, supplies an electric current to said ignition device via said electric device for exciting said ignition device to start the engine.

2. An electric device mounting structure of an outboard engine, comprising:

a cylinder block including at least one cylinder formed therein;

a recessed part formed in said cylinder block at a position away from said cylinder and constituting part of a cooling water jacket;

cover means secured to said cylinder block and covering said cooling water jacket such that said recessed part is closed, said cover means having a peripheral edge being fastened to said cylinder block by means of a bolt, said recessed part and said peripheral edge having respective portions aligned with one direction of said cylinder block, said electric device being shaped to extend along said one direction;

boss means projectedly provided on said cover means exteriorly of said recessed part; and an electric device detachably secured to said boss means with a space defined between said cylinder block and said electric device and having a number of cooling fins extending into said space.

3. An electric device mounting structure according to claim 2, said cover means having a peripheral edge being fastened to said cylinder block by means of a bolt, said recessed part and said peripheral edge having respective portions aligned with one direction of said cylinder block, said electric device being shaped to extend along said one direction.

4. An electric device mounting structure according to claim 2, said electric device having voltage restricting and rectifying functions.

5. An engine starting apparatus for starting an engine to be mounted on an outboard engine, comprising:

motor starter means adapted to be actuated by a battery for cranking said engine;

manual starter means for manually cranking said engine;

an ignition device connected to said battery;

an AC generator adapted to be driven by said engine; and an electric device for voltage restricting and rectifying an alternating current generated by said generator while restricting a voltage value of said alternating current and supplying the resultant current for charging said battery while the engine is running and also to said ignition device for exciting said ignition device when said manual starter means is manually actuated to manually crank the engine.

6. An engine starting apparatus according to claim 5, said ignition device and said motor starter means being connected to said battery in parallel, said AC generator being connected to said battery via said electric device.

7. An engine starting apparatus according to claim 6, said motor starter means being a starter motor, said manual starter means being a starter pulley secured to an upper surface of a rotor of said AC generator.

8. An engine starting apparatus according to claim 5, said electric device being provided with a full-wave bridge rectifier circuit employing four diodes, two thyristors, and a control circuit for controlling said thyristors.

9. An engine starting apparatus according to claim 8, said motor starter means being a starter motor, said manual starter means being a starter pulley secured to an upper surface of a rotor of said AC generator.

10. An engine starting apparatus according to claim 5, said motor starter means being a starter motor, said manual starter means being a starter pulley secured to an upper surface of a rotor of said AC generator.

* * * * *